US007530893B2

(12) United States Patent
Thomas

(10) Patent No.: US 7,530,893 B2
(45) Date of Patent: May 12, 2009

(54) WAGERING GAME WITH DYNAMIC VISUAL GAMING INDICIA

(75) Inventor: Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 545 days.

(21) Appl. No.: 11/055,153

(22) Filed: Feb. 10, 2005

(65) Prior Publication Data

US 2006/0178199 A1 Aug. 10, 2006

(51) Int. Cl.
*A63F 9/24* (2006.01)

(52) U.S. Cl. ..... 463/20

(58) Field of Classification Search ..... 463/16–0
See application file for complete search history.

(56) References Cited

U.S. PATENT DOCUMENTS 5,855,514 A * 1/1999 Kamille ..... 463/17
6,485,367 B1 11/2002 Joshi ..... 463/13
6,565,436 B1 * 5/2003 Baerlocher ..... 463/26
2002/0090990 A1 * 7/2002 Joshi et al. ..... 463/20
2003/0139214 A1 * 7/2003 Wolf et al. ..... 463/42
2003/0195031 A1 * 10/2003 O'Donovan et al. ..... 463/16
2003/0216167 A1 * 11/2003 Gauselmann ..... 463/25

* cited by examiner

*Primary Examiner*—Dmitry Suhol
*Assistant Examiner*—Jasson H Yoo
(74) *Attorney, Agent, or Firm*—Nixon Peabody LLP

(57) ABSTRACT

A method for playing a wagering game includes receiving a wager input from a player for playing a wagering game. In response to receiving the wager input, at least one randomly-selected outcome of a plurality of outcomes is selected, and visual indicia is presented during a first game cycle of the wagering game. The visual indicia is randomly changed to altered visual indicia in a subsequent game cycle of the wagering game, wherein the altered visual indicia provides a fresh look for the subsequent game cycle of the wagering game.

19 Claims, 17 Drawing Sheets

26

26

WAGERING GAME WITH DYNAMIC VISUAL GAMING INDICIA

FIELD OF THE INVENTION

The present invention relates generally to gaming terminals for playing a wagering game and, more particularly, to a gaming terminal having visual gaming indicia that randomly changes to give the wagering game a fresh appearance.

BACKGROUND OF THE INVENTION

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, shrewd operators strive to employ the most entertaining and exciting machines available because such machines attract frequent play and, hence, increase profitability to the operator. In the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is that of a "secondary" or "bonus" game which may be played in conjunction with a "basic" game. The bonus game, which is entered upon the occurrence of a selected event such as a start-bonus outcome of the basic game, may comprise any type of game, either similar to or completely different from the basic game. Such a bonus game produces a significantly higher level of player excitement than the basic game because it provides a greater expectation of winning than the basic game.

A wager received from a player generally purchases a single game cycle of a game. The machine generates a random event for the purchased game cycle and provides an award to the player for a winning outcome of the random event. Each cycle of the game is generally independent of other game cycles such that a given game cycle is not correlated with prior or succeeding game cycles. Occasionally, the random event for a purchased game cycle may trigger a bonus game involving lively animations, display illuminations, special effects, and/or player interaction, but the hit frequency for such bonus games is generally so low (e.g., once every 100 game cycles) that a player's gaming experience is still essentially the same from one game cycle to the next. This low hit frequency is generally dictated by underlying math models used in the game to select game outcomes.

One problem associated with some current wagering games is that visual gaming indicia remains constant throughout each game cycle of a wagering game. Regardless of whether the visual gaming indicia includes selectable elements (i.e., elements that affect the play of the game or the amount of a payout) or background elements (i.e., elements that do not affect the play of the game or the amount of a payout), the position, the number, and the characterization of the elements does not change throughout the game cycles of the wagering game. For example, the layout of selectable elements of a bonus game of a game cycle remains identical for most, if not all, of the game cycles in which the bonus game is awarded to the player. Such static display of visual gaming indicia decreases the likelihood that the player will be excited or entertained by the wagering game.

Thus, there is a need to provide a wagering game that includes a dynamic randomization of visual gaming indicia to provide a fresh appearance for each game cycle of the wagering game. The present invention fulfills this and other needs.

SUMMARY OF THE INVENTION

A method for playing a wagering game includes receiving a wager input from a player for playing a wagering game. In response to receiving the wager input, at least one randomly-selected outcome of a plurality of outcomes is selected, and visual indicia is presented during a first cycle of the wagering game. The visual indicia is randomly changed to altered visual indicia in a subsequent cycle of the wagering game, wherein the altered visual indicia provides a fresh look for the subsequent cycle of the wagering game.

In another aspect of the present invention, a method for conducting a wagering game includes receiving wager inputs from a player for a wagering game and, in response to receiving the wager inputs, selecting at least one randomly-selected outcome of a plurality of outcomes. A first data set of visual indicia and a second data set of altered visual indicia are stored. The visual indicia is presented during a first cycle of the wagering game. The visual indicia is randomly changed to altered visual indicia before playing a subsequent cycle of the wagering game.

In an alternative aspect of the present invention, a gaming system for playing a wagering game on a gaming terminal includes a display on the gaming terminal for displaying at least one randomly-selected outcome of a plurality of outcomes, in response to accepting wager inputs from a player during the wagering game. The gaming system also includes a controller coupled to the display and programmed to present visual indicia during a cycle of the wagering game. The controller is further programmed to randomly change the visual indicia to altered visual indicia in a subsequent game cycle played by the player, to provide a fresh look for the subsequent game cycle.

The above summary of the present invention is not intended to represent each embodiment, or every aspect, of the present invention. Additional features and benefits of the present invention are apparent from the detailed description, figures, and claims set forth below.

Figure 1:
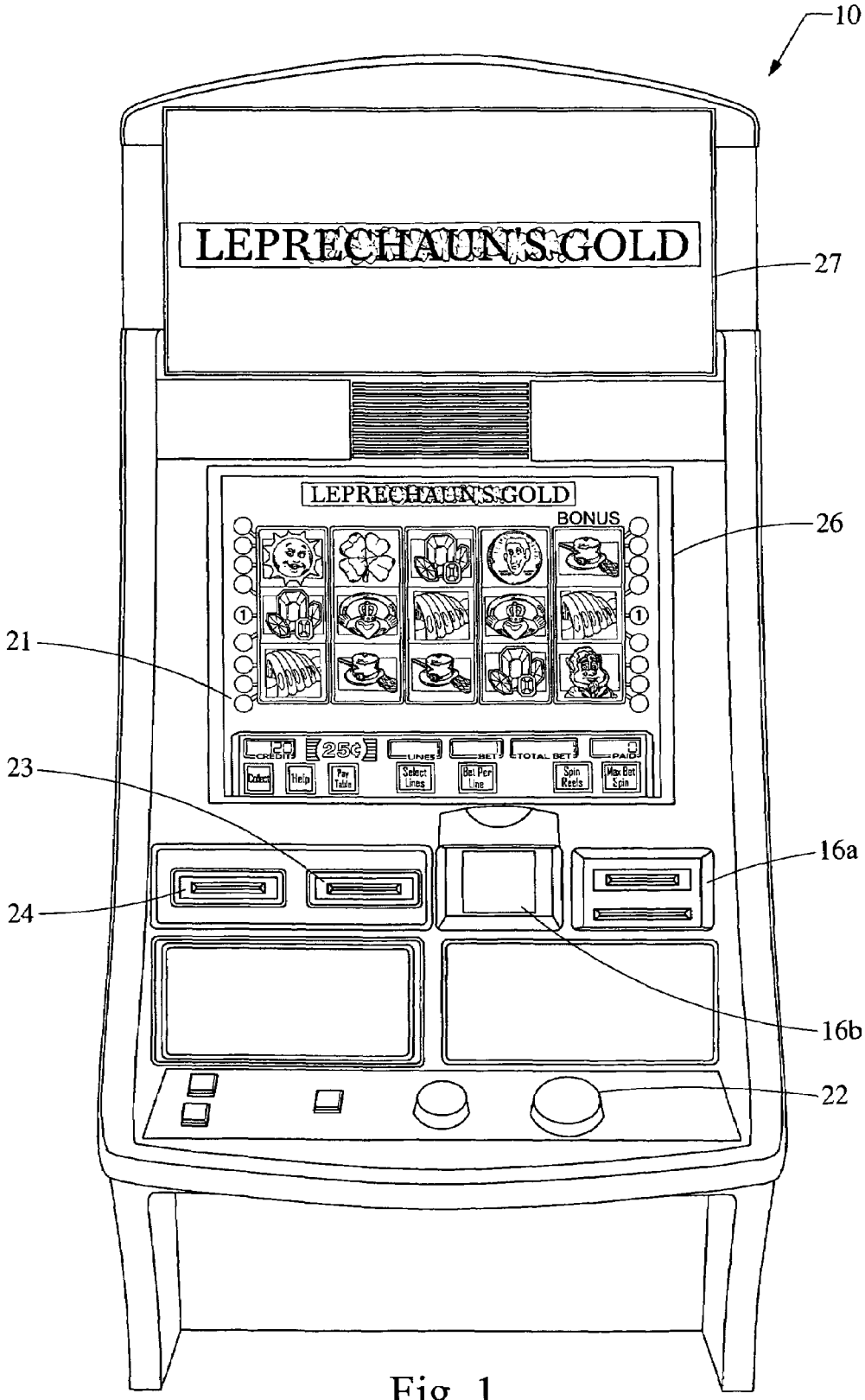
FIG. 1 is a perspective view of a video gaming terminal according to one embodiment of the present invention.

While the invention is susceptible to various modifications and alternative forms, specific embodiments are shown by way of example in the drawings and are described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Referring to FIG. 1, a gaming terminal 10 is used in gaming establishments such as casinos. With regard to the present invention, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play a video casino game, such as blackjack, slots, keno, poker, etc. The current invention is focused on video or mechanical slot games.

The gaming terminal 10 includes input devices, such as a wager acceptor 16, a touch screen 21, a push-button panel 22, and a player-identification card reader 24. For output the gaming terminal 10 includes a payout mechanism 23 and a main display 26. The main display 26 displays information about the basic wagering game and, optionally, displays information about a bonus wagering game and a progressive wagering game. The gaming terminal 10 may optionally include a secondary game display 27 for displaying the bonus wagering game, or for displaying award amounts of a progressive game. While these typical components found in the gaming terminal 10 are described below, it should be understood that numerous other elements may exist and may be used in any number of combinations to create various forms of a gaming terminal.

The wager acceptor 16 may be provided in many forms, individually or in combination. The wager acceptor 16 may include a note acceptor 16*a* or coin slot acceptor 16*b* to input value to the gaming terminal 10. Or, the wager acceptor 16 may include a card-reading device for reading a card that has a recorded monetary value with which it is associated. The card may also authorize access to a central account, which can transfer money to the gaming terminal 10.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game.

The operation of the basic wagering game is displayed to the player on the main display 26 and includes a plurality of video reels. The main display 26 can also display the bonus game associated with the basic wagering game. The main display 26 may take the form of a cathode ray tube (CRT), a high resolution LCD, a plasma display, a LED, or any other type of video display suitable for use in the gaming terminal 10. As shown, the main display 26 includes the touch screen 21 overlaying the entire monitor (or a portion thereof) to allow players to make game-related selections. Alternatively, the gaming terminal 10 may have a number of mechanical reels to display the game outcome.

The player-identification card reader 24 allows for the identification of a player by reading a card with information indicating his or her true identity. Currently, casinos use the identification provided to reward certain players with complimentary services or special offers. For example, a player may be enrolled in the gaming establishment's players' club and may be awarded certain complimentary services as that player collects points in his or her player-tracking account. The player inserts his or her card into the player-identification card reader 24, which allows the casino's computers to register that player's wagering at the gaming terminal 10.

A player begins play of the basic wagering game by inserting a wager input into the wager input accepter 16 of the gaming terminal 10. In direct response to the wager, the gaming machine provides the player with a series of cycles of the game. For each "game cycle," the gaming machine generates at least one random event using a random number generator at the beginning of the cycle and provides an award to the player for a winning outcome of the random event. A player can select play by either using the touch screen 21 or the push-button panel 22. One or more outcomes of a plurality of outcomes are randomly selected in response to the wagering input by the player. One of the pluralities of randomly-selected outcomes is a start-bonus outcome, which can include any variations of symbols or symbol combinations triggering a bonus game.

Figure 2:
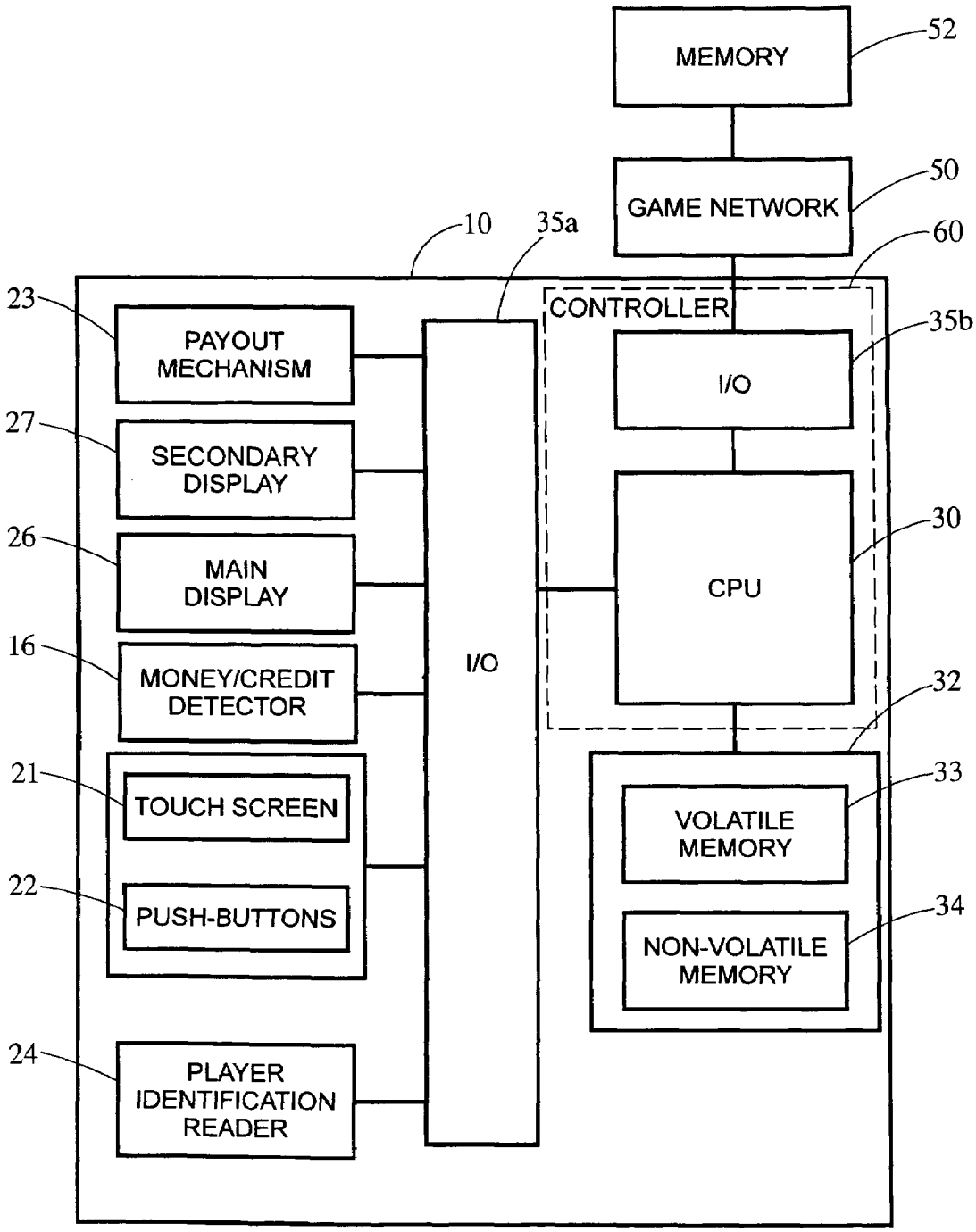
FIG. 2 is a block diagram of the gaming terminal of FIG. 1.

As shown in FIG. 2, the various components of the gaming terminal 10 are controlled by a central processing unit (CPU) 30, also referred to as a processor (such as a microprocessor or microcontroller). To provide the gaming functions, the CPU 30 executes one or more game programs. The CPU 30 performs the random selection of an outcome from the plurality of outcomes of the wagering game. The CPU 30 is also coupled to or includes a system memory 32. The system memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

The gaming terminal 10 is typically operated as part of a game control network 50 having control circuitry and one or more memory devices 52. The gaming terminal 10 often has multiple serial ports, each port dedicated to providing data to a specific host computer system that performs a specific function (e.g., accounting system, player-tracking system, progressive game control system, etc). To set up a typical serial communication hardware link to the host system, the typical RS-232 point-to-point communication protocol that is often present in the gaming terminal 10 is converted to an RS-485 (or RS-485-type) master-slave protocol so as to take advantage of some of the advantages of the RS-485 capability (e.g., multi-drop capability that allows many gaming terminals 10 to communicate with the game control network 50). To perform this function, a custom interface board may be used by the gaming terminal 10 for each communication port in the gaming terminal 10. It should be noted that the gaming terminal 10 can initially be designed to be configured for a typical RS-485 protocol, instead of the typical RS-232 protocol. Further, the gaming terminal 10 may simply be designed for an Ethernet connection to the game control network 50.

The gaming terminal 10 and associated gaming control system is capable of executing wagering games on or through a controller 60. Controller 60, as used herein, comprises any combination of hardware, software, and/or firmware that may be disposed or resident inside and/or outside of a gaming terminal 10 or like machine which may communicate with and/or control the transfer of data between the gaming terminal and a bus, another computer, processor, or device, and/or a service and/or a network. The network may include, but is not limited to a peer-to-peer, client/server, master/slave, star network, ring network, bus network, or other network architecture wherein at least one processing device (e.g., computer) is linked to at least one other processing device. The controller 60 may comprise the I/O circuits 35*a*, 35*b* and the CPU 30. In other embodiments, the CPU 30 may be housed outside of the controller 60, and a different processor may be housed within the controller 60. The controller 60, as used herein, may comprise one or more controllers. In one implementation, each gaming terminal 10 comprises, or is connected to, a controller 60 enabling each gaming terminal 10 to transmit and/or receive signals, preferably both, in a peer-to-peer arrangement. In another example, the controller 60 may be adapted to facilitate communication and/or data transfer for one or more gaming terminals 10 in a client/server or centralized arrangement. In one aspect, shown in FIG. 2, the controller 60 may connect the gaming terminal 10 via a conventional I/O port and communication path (e.g., serial, parallel, IR, RC, 10*b*T, etc.) to a game network 50, which may include, for example, other gaming terminals connected together in the network 50.

Figure 3:
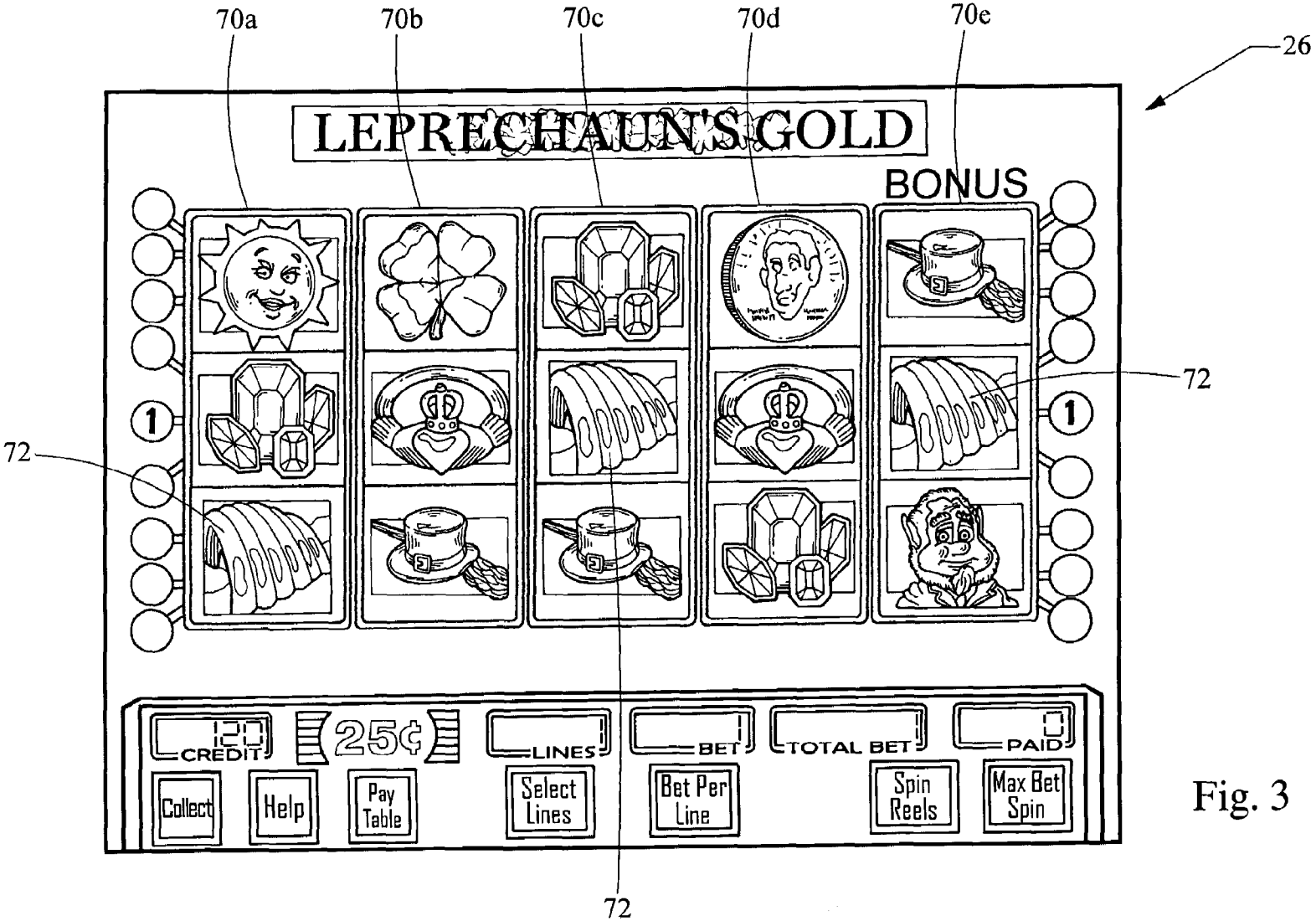
FIG. 3 is an illustration of a bonus trigger screen, according to one embodiment of the present invention.

Referring now to FIG. 3, the main display 26 includes a plurality of reels 70*a*-70*e*, each reel having a plurality of symbols 72. After the reels 70*a*-70*e* stop spinning (or stop simulating spinning if the reels are video reels), the symbols 72 indicate a randomly-chosen outcome, such as a bonus-triggering outcome. For example, a bonus game is triggered if three rainbow symbols 72 land in any position on the first reel 70*a*, third reel 70*c*, and fifth reel 70*e*. As shown in FIG. 3, a first rainbow symbol 72 has landed in the bottom position of the first reel 70*a*, a second rainbow symbol 72 has landed in the center position of the third reel 70*c*, and a third rainbow symbol 72 has landed in the center position of the fifth reel 70*e*. Consequently, a primary bonus during an initial game cycle has been triggered.

Figure 4:
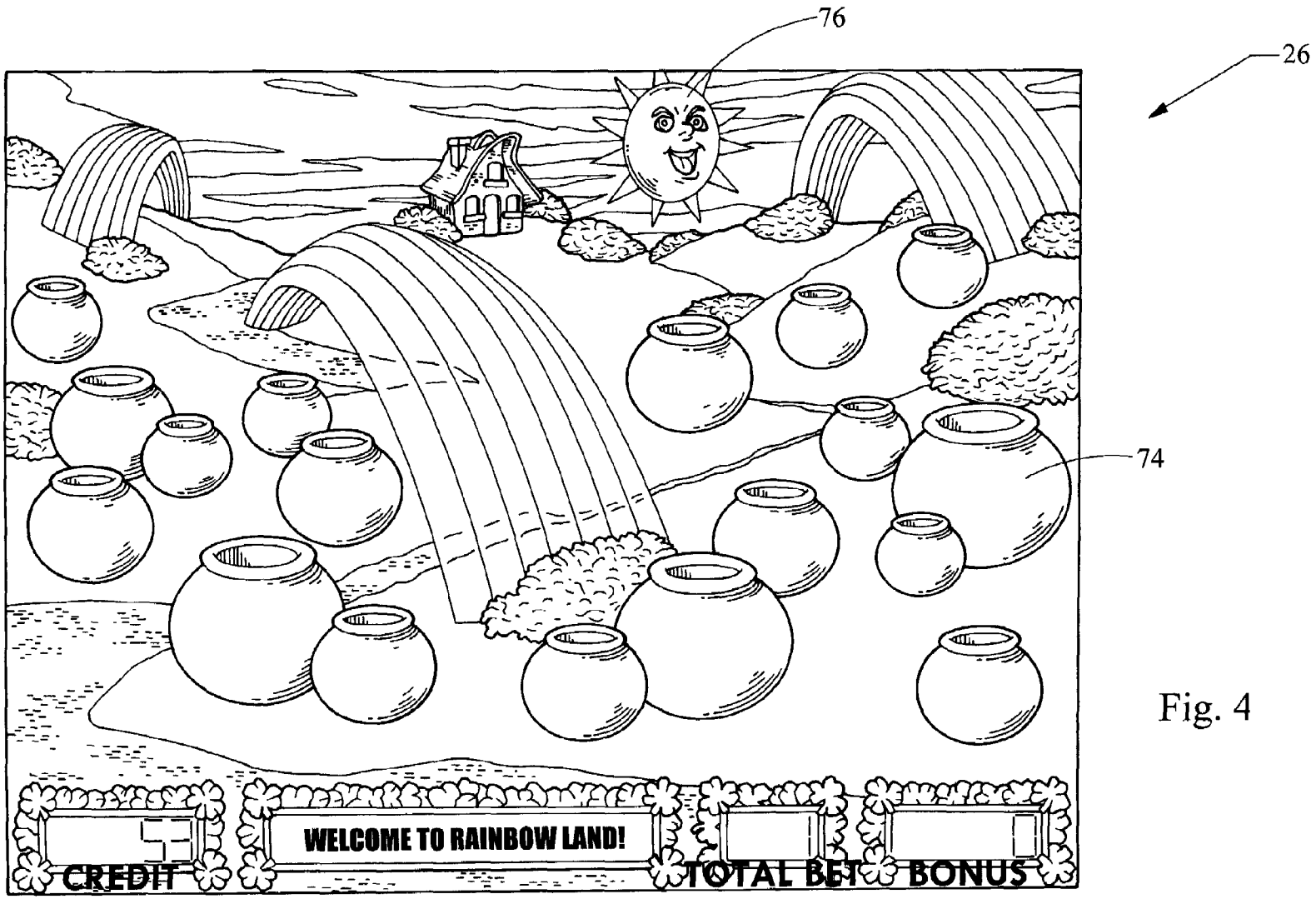
FIG. 4 is an illustration of a first bonus screen before player selection has begun, according to one embodiment of the present invention.

Referring to FIG. 4, the main display 26 shows an initial, or primary, screen of the primary bonus. Eighteen pots of gold 74 of various sizes are scattered throughout the land, as shown. The pots of gold 74 are selectable elements that a player can select to affect the payout of the bonus game. To select a pot of gold 74, for example, the player can use a finger to touch the desired pot of gold 74. Seamus the Sun 76 is a background element that instructs the player to begin selecting pots of gold 74. Other background elements, which do not affect the payout of the bonus game, are the rainbows, the house, and the grass patches. Both the selectable elements and the background elements can be referred to collectively as visual gaming indicia. As used in this application, the definition of the term indicia includes at least one indicium, or indicator (i.e., the term indicia includes a singular and a plural meaning).

Figure 5:
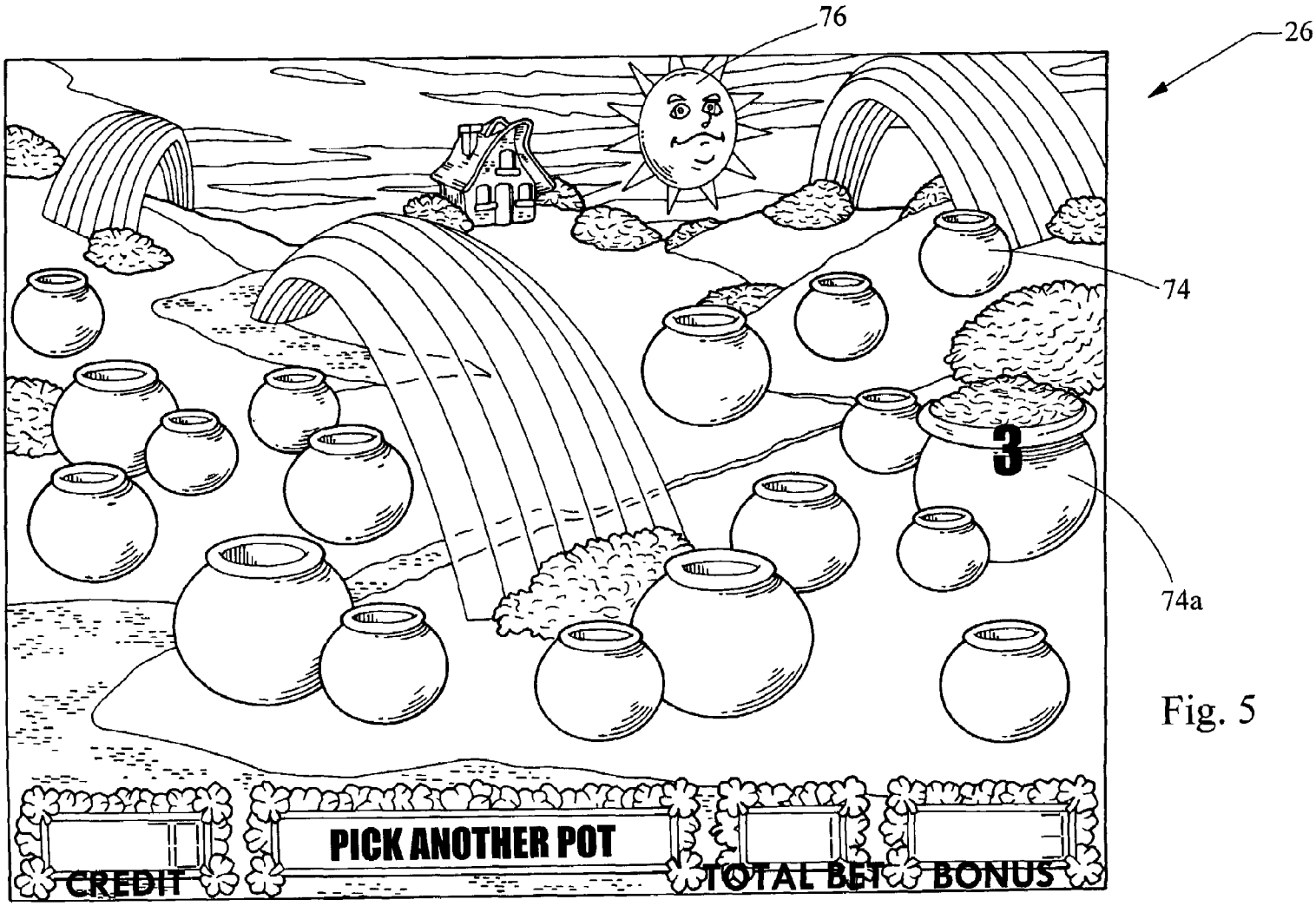
FIG. 5 is an illustration of the first bonus screen of FIG. 4 after player selection has begun.

Referring to FIG. 5, the player has selected one pot of gold 74*a*. The selection reveals an animation of gold filling up in the pot, and the player will win a credit amount based on how high the gold fills up. The player is then prompted to select another pot 74, until the selected pot 74 contains Lucky the Leprechaun.

Figure 6:
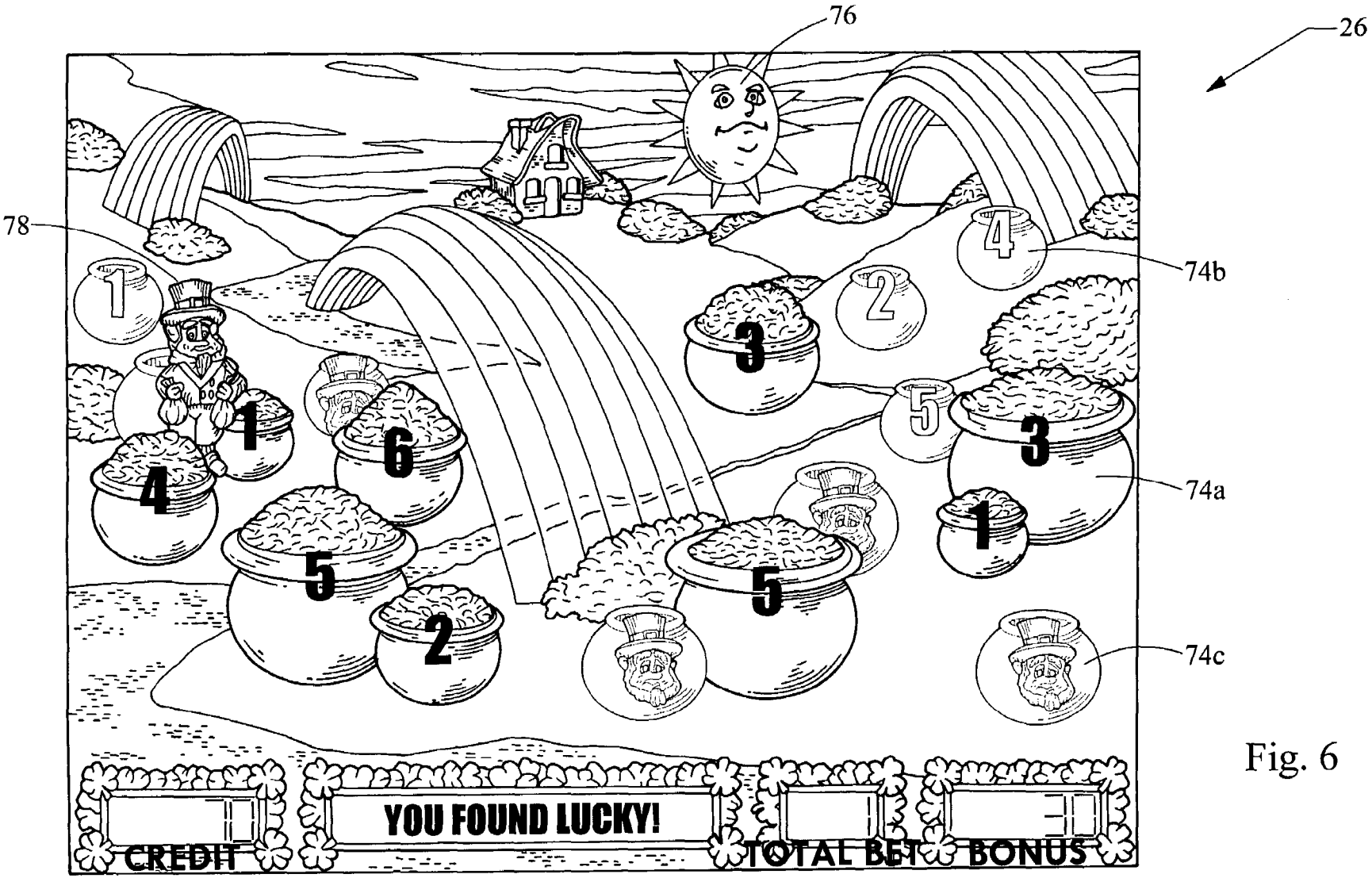
FIG. 6 is an illustration of the first bonus screen of FIG. 4 after player selection has ended.

Referring to FIG. 6, the player has selected the pot 74 that contains the Leprechaun 78 and the primary bonus ends. The Leprechaun 78 jumps out of the pot 74 to indicate the end of the primary bonus, and the player is awarded all the credits that have been collected in the selected pots 74*a*. During this primary bonus, the player has won 30 credits. Optionally, the contents of the unselected pots 74*b*, 74*c* are revealed to the player. For example, the unselected pots 74*b*, which contain gold, are revealed to the player to show the number of credits that the player would have received had the unselected pots 74*b* been selected. Similarly, the unselected pots 74*c*, which contain the Leprechaun 78, are also revealed to the player. Before exiting the primary bonus, the Leprechaun 78 disappears and gives the player one last chance to win some of his gold. In this embodiment, the Leprechaun 78 is referred to as a "Positive Pooper" because its appearance does not send the player back to the basic game but instead sends the player to a secondary bonus game of the initial game cycle. Alternatively, the appearance of the Leprechaun 78 can send the player back to the basic game.

Figure 7:
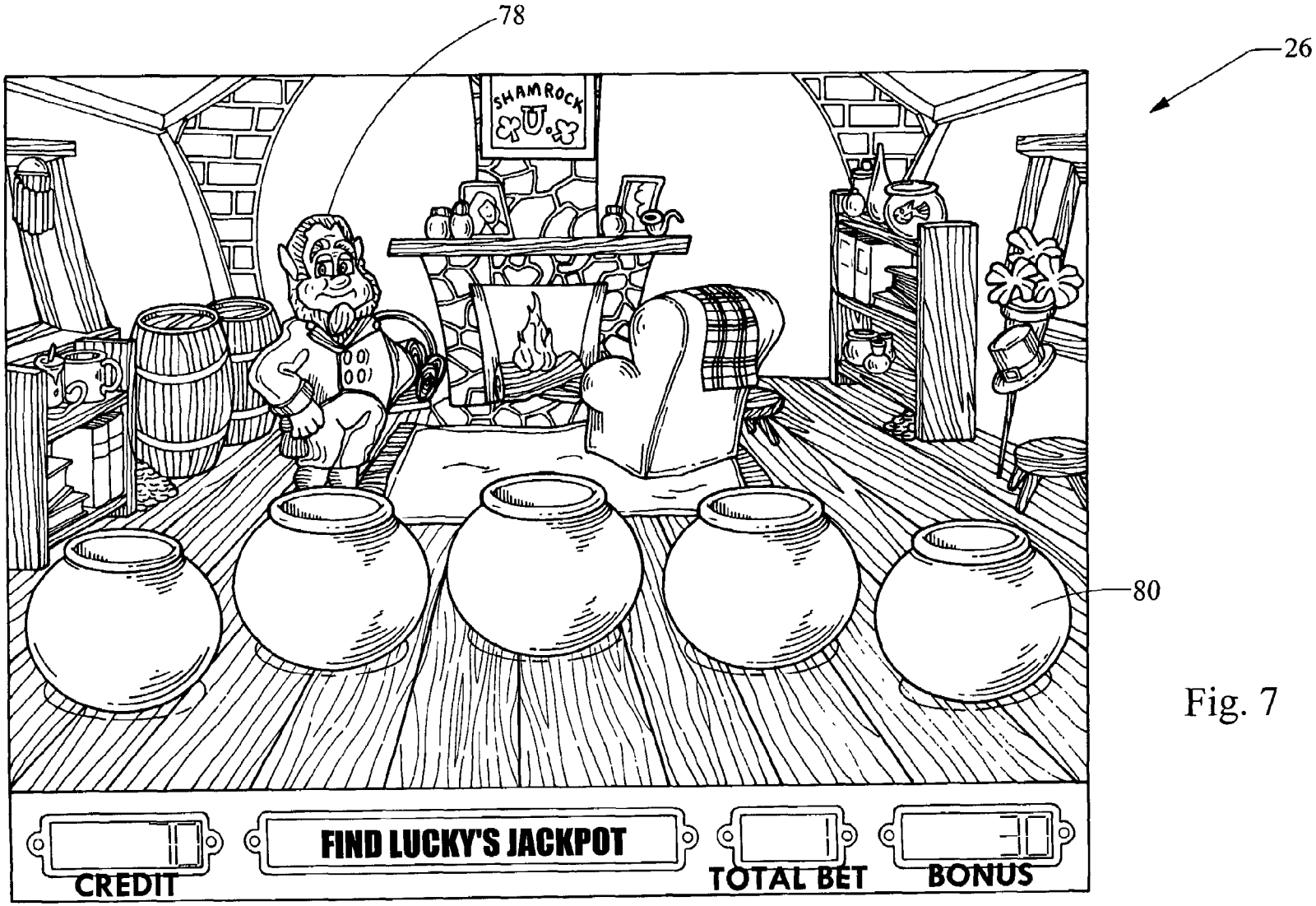
FIG. 7 is an illustration of a second bonus screen before player selection has begun, according to another embodiment of the present invention.

Referring to FIG. 7, a secondary screen of the bonus game (this part of the bonus game is also referred to as a secondary bonus) shows the Leprechaun 78 inside his house, next to five pots of gold 80. The pots 80 are arranged from left to right and are each approximately the same size and shape. The Leprechaun 78 instructs the player to select only one of the pots 80.

Figure 8:
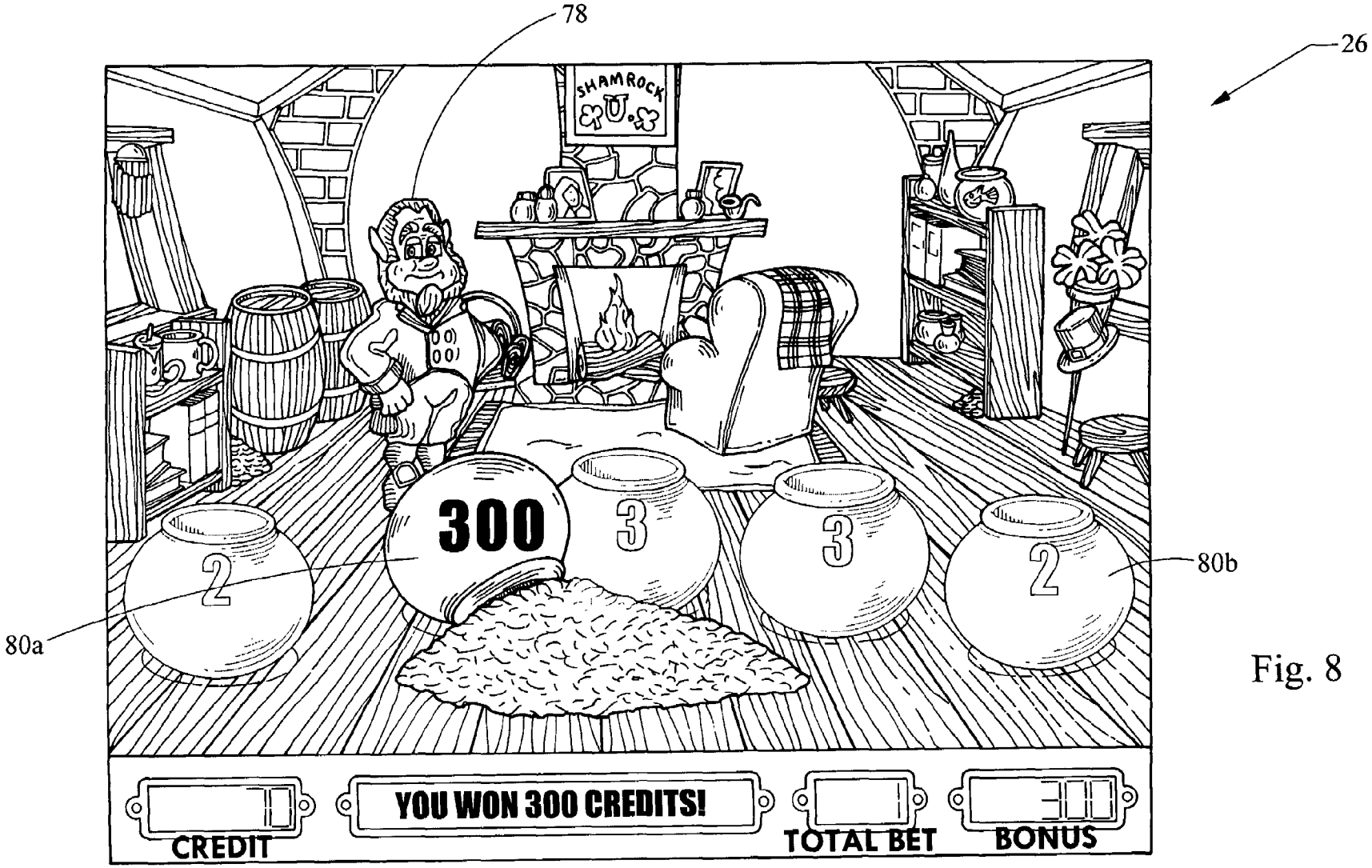
FIG. 8 is an illustration of the second bonus screen of FIG. 7 after player selection has ended.

Referring to FIG. 8, the player has selected the second pot 80*a*, which spills the gold on the floor and reveals that the player has won a total of 300 credits for both bonus games of the initial game cycle. In one embodiment, the pots 80 contain one large multiplier, such as 10, and four small multipliers, such as 2 and 3. As shown, the player has selected the large multiplier 10, and the 30 credits won in the primary bonus have been multiplied by 10 to yield the 300 credits won in both bonus games, the primary bonus and the secondary bonus. After the player has selected the pot 80*a*, the multiplier for each of the unselected pots 80*b* is revealed to the player. Optionally, the unselected pots 80*b* are grayed out when revealing what the player did not win. The bonus game ends after the credit amount has been awarded, and the player is taken back to the basic reel game.

Figure 9:
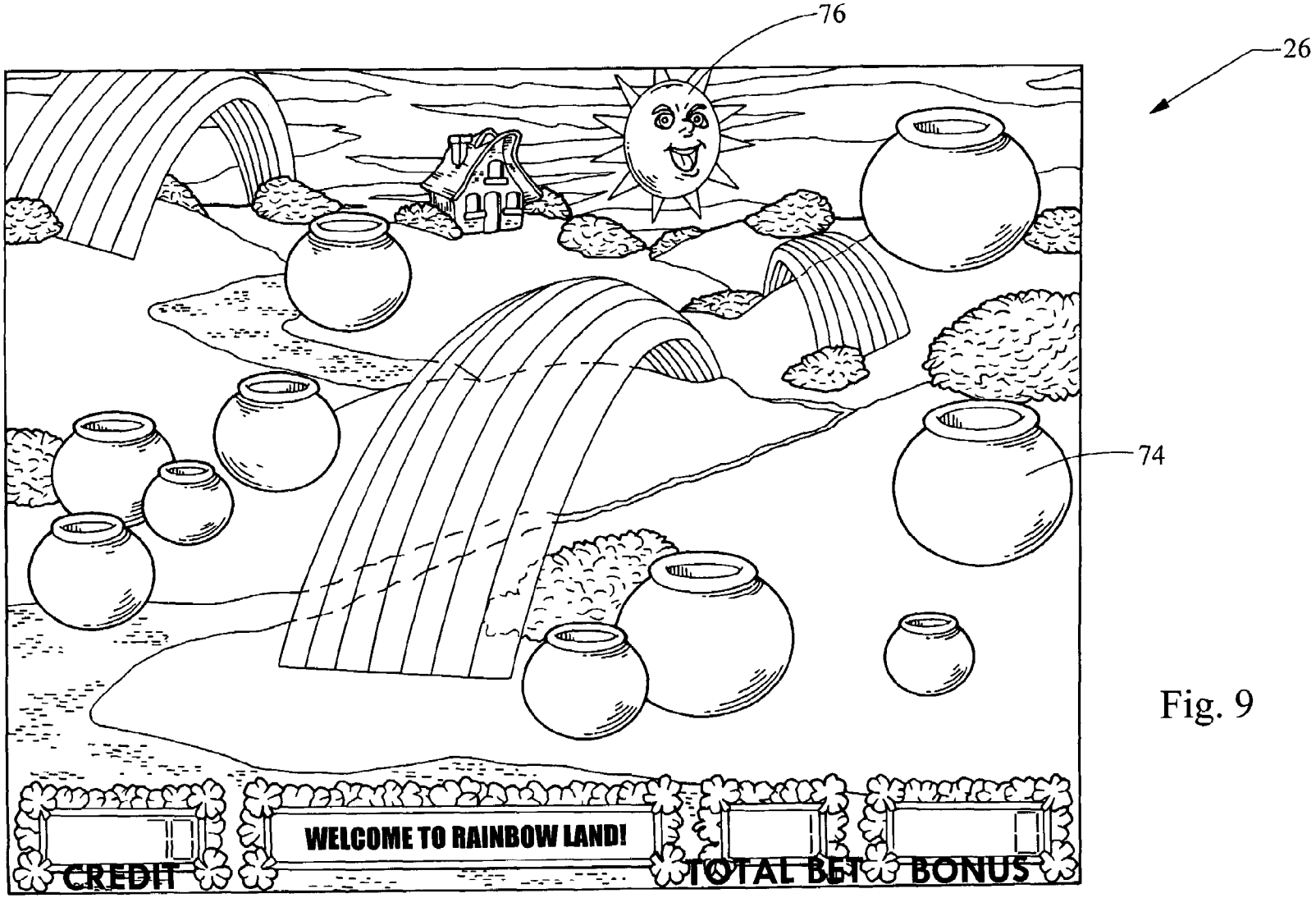
FIG. 9 is an illustration of a first bonus screen before player selection has begun, according to an alternative embodiment of the present invention.

Referring to FIG. 9, a randomly-changed layout of the primary bonus game is presented during a subsequent primary bonus game that is triggered after the bonus game of FIGS. 4-8. To provide a fresh appearance of the bonus game to the player, the gaming visual indicia has been randomly changed. For each game cycle, the gaming visual indicia changes randomly to provide the player with a dynamic game play experience. The randomization of the gaming visual indicia has no repeating or predictable pattern. In one embodiment, the random change of the visual indicia can occur anytime before the player begins playing the particular game cycle, or it can occur during a specific game-play event, e.g., before the bonus game has been triggered.

Providing a new, or different, look increases the likelihood that the player will not grow tired of the game and will continue playing for extended periods of time. For example, as shown in FIG. 9, the number of pots have now changed from 18 pots 74 (FIGS. 4-6) to 10 pots 74. Similarly, the size and location of the pots have also been randomly changed, as have the size and location of some background elements (e.g., the rainbows).

In an alternative embodiment, the randomization of the displayed elements may gradually gravitate over time toward the favorite of a particular player (specific to a gaming session) or toward the favorite of a plurality of players as a whole (not specific to a gaming session). A gaming session generally ends when the player cashes-out his or her winnings. The gradual gravitation of the elements towards a favorite element layout can be based, for example, on how much the gaming terminal 10 is played for different layout representations, previous wagering inputs, the amount of time of at least one previous game cycle, and the amount of time of at least one previous wagering session. Thus, the game may gradually "tune" itself toward player preferences as indicated by game performance, i.e., a "self-tuning" game. The game continues to alter the displayed visual indicia to see what works best. In general, the "self-tuning" concept focuses the randomization of the displayed elements to a specific, or preferred, group of possible layouts of the displayed elements. Initially, the randomization of displayed elements is based on a broad group of possible layouts of the displayed elements. As the game determines particular preferences, the randomization is based on a narrower (preferred) group of the possible layouts of the displayed elements.

For example, a first element layout has been randomly-selected during a first wagering session of a particular wagering game, and a second element layout has been randomly-selected during a second wagering session of the wagering game. The time spent playing the wagering game during the first wagering session is much greater than the time spent playing the wagering game during the second wagering session. Accordingly, a determination is made that the first element layout is a preferred layout and it is included in a preferred group of element layouts. Optionally, a preferred layout can be excluded from the preferred group of layouts if future performance indicates that the layout is no longer preferred.

Figure 10:
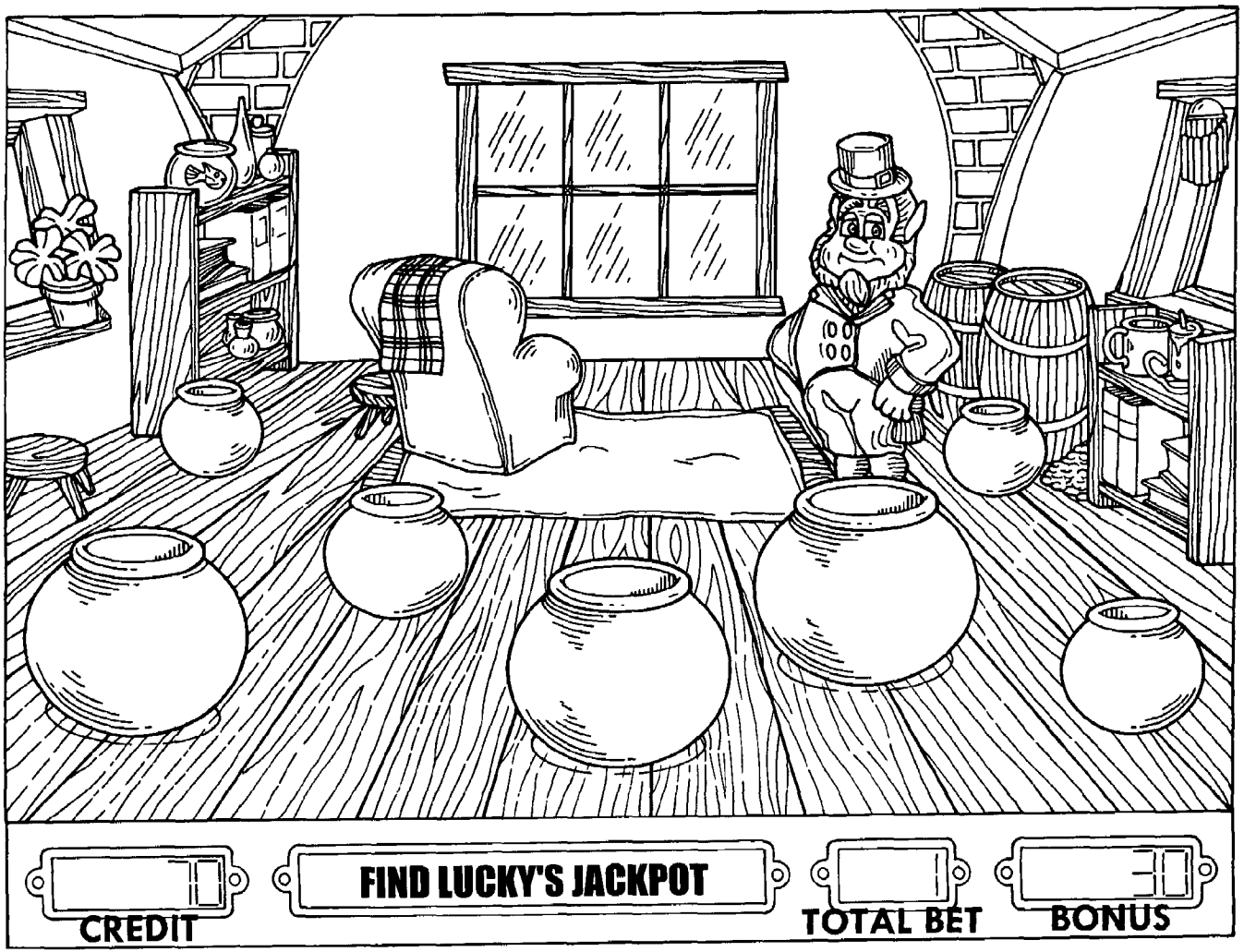
FIG. 10 is an illustration of a second bonus screen before player selection has begun, according to an alternative embodiment of the present invention.

Referring to FIG. 10, a randomly-changed layout of the secondary bonus is presented during a subsequent game cycle that has awarded a secondary bonus. For example, the number of pots 80 has been increased to 7 (compared to FIG. 7), and the size and location of the pots 80 has changed. Further, background elements such as the Leprechaun 78 and the furniture have also been changed.

Figure 11:
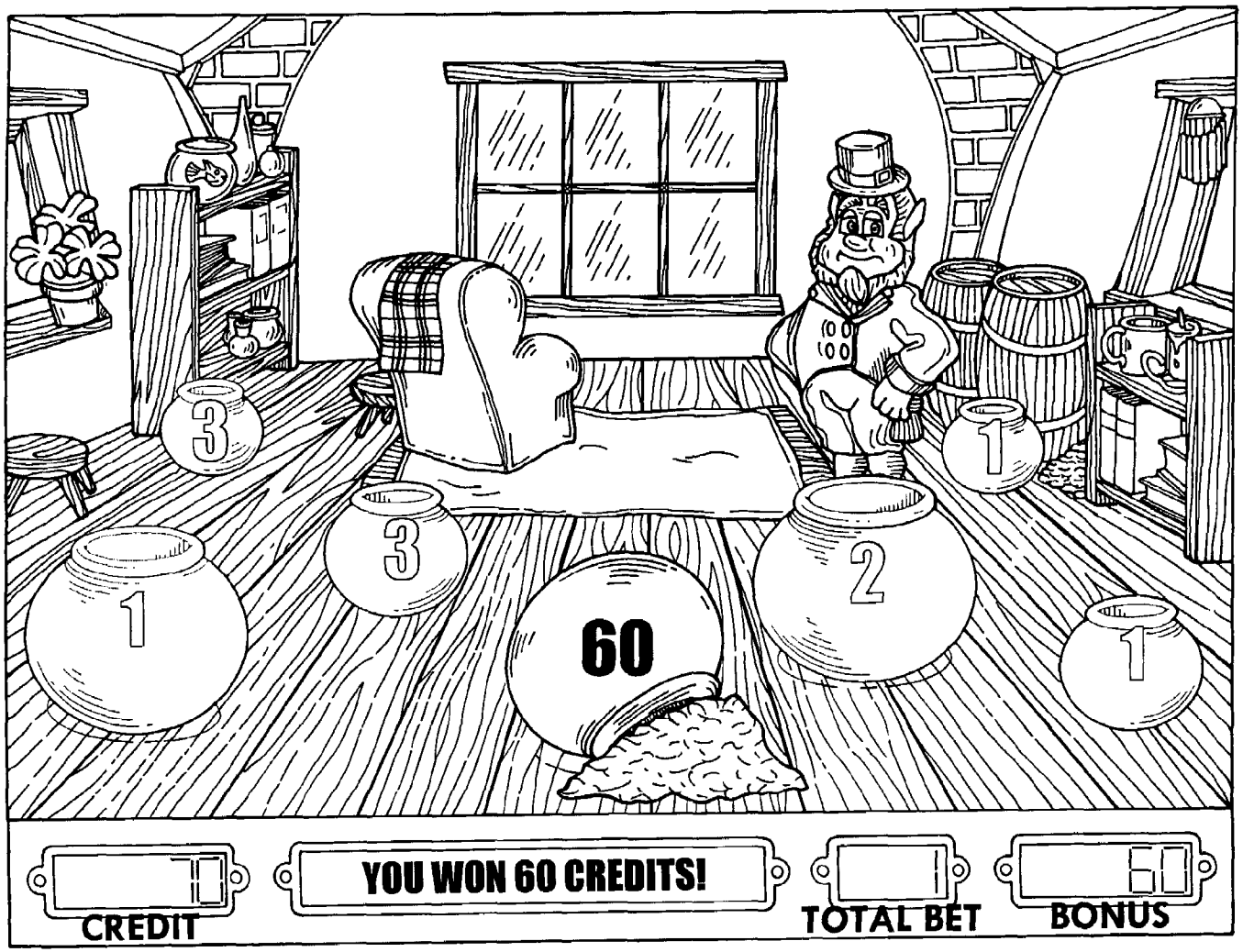
FIG. 11 is an illustration of the second bonus screen of FIG. 10 after player selection has ended.

Referring to FIG. 11, the contents of each one of the pots 80 of the secondary bonus in the subsequent game cycle have been revealed. The multiplier values for each of the pots 80 have been randomly changed as shown. In this subsequent game cycle, the selected pot 80*a* contains a multiplier value of 6, resulting in a total credit award of 60 (assuming that the credit amount awarded in the primary bonus of the subsequent cycle is 10 credits).

In alternative embodiments of the present invention, the randomization of video gaming indicia can be included in other wagering games, such as wagering games related to video representations of lottery-style scratch tickets. The layout of video scratch-off tickets, as described below in reference to the examples shown in FIGS. 12-17, can be randomly-changed to provide a fresh look for the player.

In a video scratch ticket game, the wagering game simulates the scratch-off of a video element that conceals an outcome such as an award or symbol. Using a touch screen that is capable of detecting a finger draft, a player scratches off an onscreen element to reveal an outcome in much the same way that a player reveals an outcome on a physical scratch-off lottery ticket. The scratching off action can be, for example, having the player touch the onscreen element, or having the player rub the element until the outcome is revealed.

Figure 12:
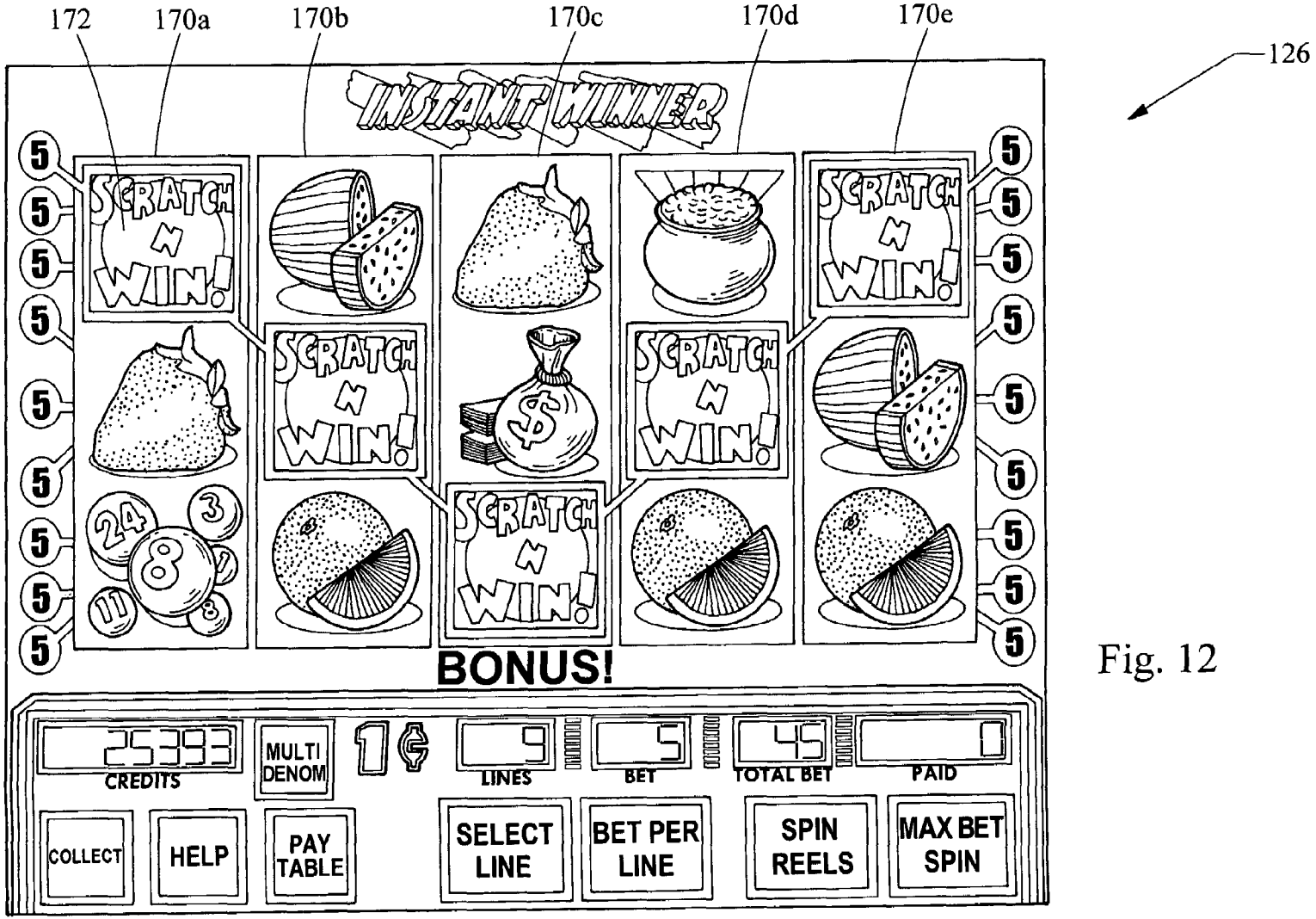
FIG. 12 is an illustration of a bonus trigger screen, according to an alternative embodiment of the present invention.

Referring to FIG. 12, a main display 126 includes a plurality of reels 170*a*-170*e* having a plurality of symbols 172, according to another embodiment of the present invention. A second bonus screen is activated to show a bonus game by aligning along an active payline either a combination of at least three SCRATCH 'N WIN symbols, or any combination of three symbols selected from SCRATCH 'N WIN symbols and Wild Jackpot symbols. As shown, the second bonus screen has been triggered because five SCRATCH 'N WIN symbols have been aligned along the active payline: a symbol in the top position of the first reel 170*a*, a symbol in the middle position of the second reel 170*b*, a symbol in the bottom position of the third reel 170*c*, a symbol in the middle position of the fourth reel 170*d*, and a symbol in the top position of the fifth reel 170*e*.

Figure 13:
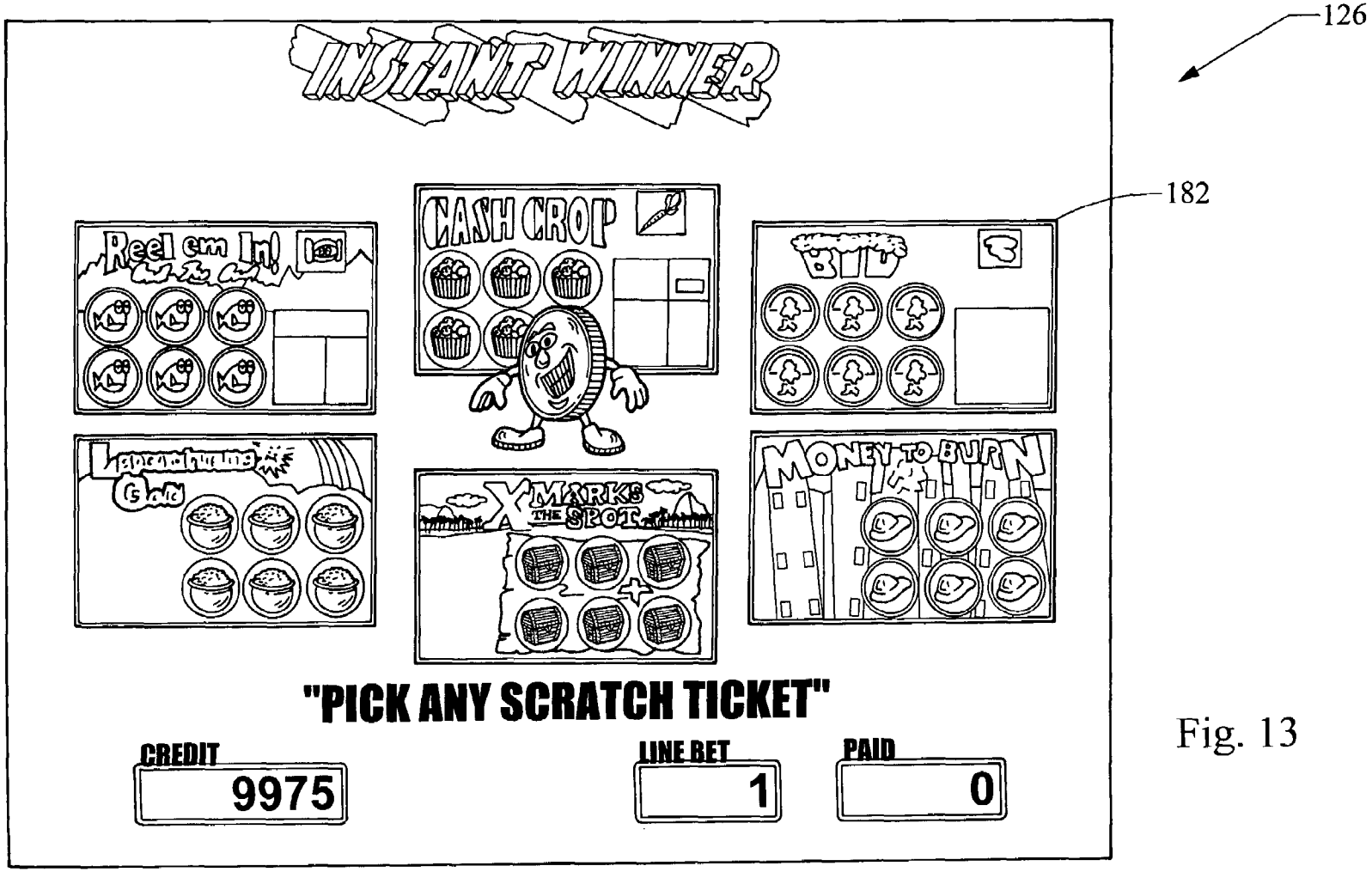
FIG. 13 is an illustration of a first bonus screen having six bonus tickets, according to the embodiment shown in FIG. 12.

Referring to FIG. 13, the second bonus screen includes six scratch-off tickets 182. As explained in more detail below, three tickets reward the player with bonus credits hidden under the scratch-off areas, and three tickets reward the player if three symbols are matched. The six tickets include, for example, a REEL 'EM IN! ticket 182 and an X MARKS THE SPOT ticket 182. Each ticket has its own distinct game theme, which is optionally associated with other popular wagering games.

Figure 14:
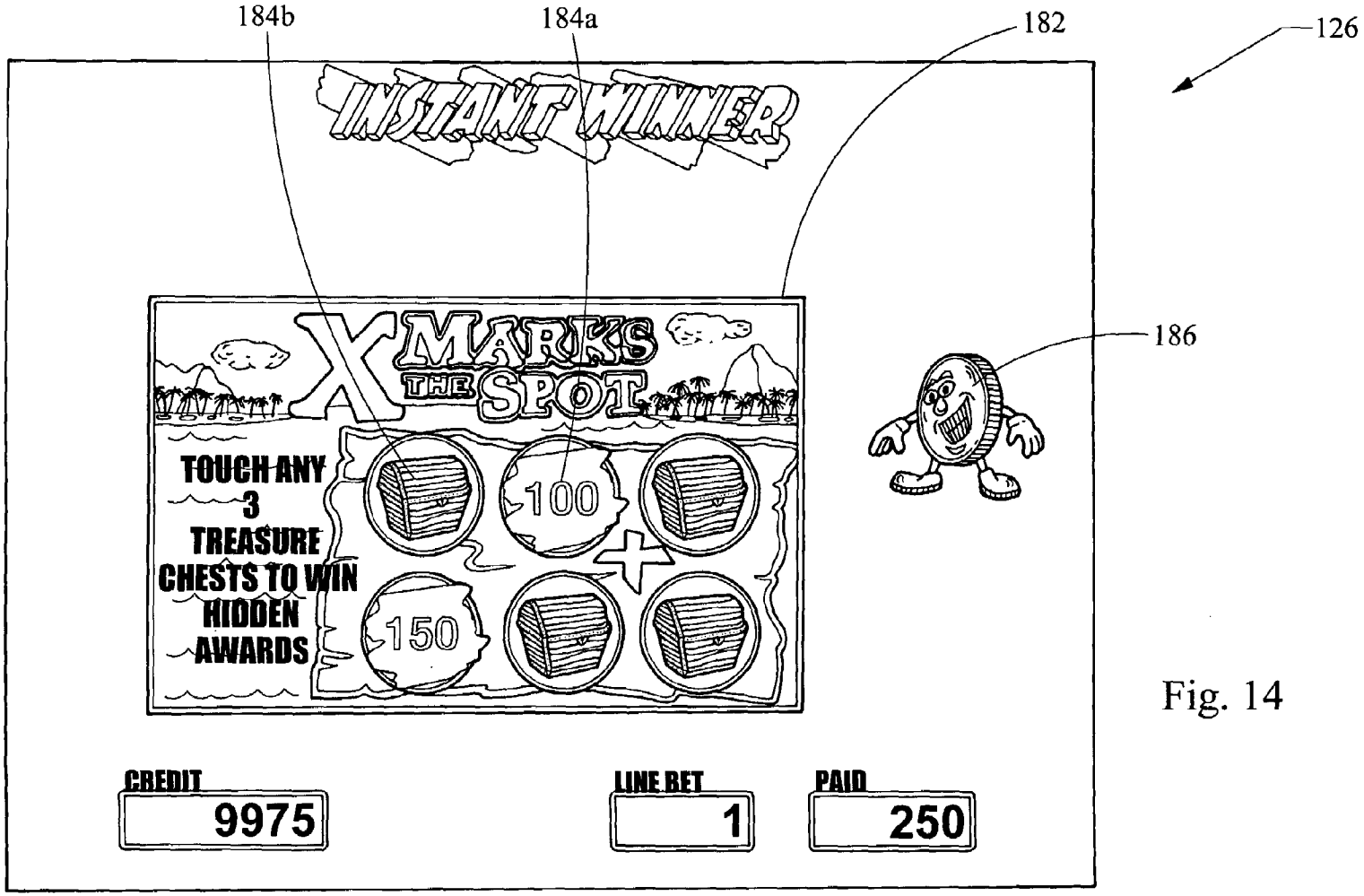
FIG. 14 is an illustration of a second bonus screen of a scratch-off ticket having two symbols revealed, according to the embodiment shown in FIG. 12.

Referring to FIG. 14, the player has selected the X MARKS THE SPOT ticket 182, which includes six selectable elements 184*a*, 184*b*. The player selects three elements 184*a* to reveal a credit award hidden under the area obscured from the player. For example, so far the player has selected two treasure chests 184*a*, revealing a credit award of 100 and a credit award of 150. Upon touching the respective treasure chest 184*a*, the wagering game simulates the scratching, or removal, of the treasure chest symbol to reveal the respective credit award. An animated coin character 186 cheers on the player as the selected elements 184*a* are scratched-off. During the scratching action, the wagering game plays a theme music that is associated with the selected ticket.

Figure 15:
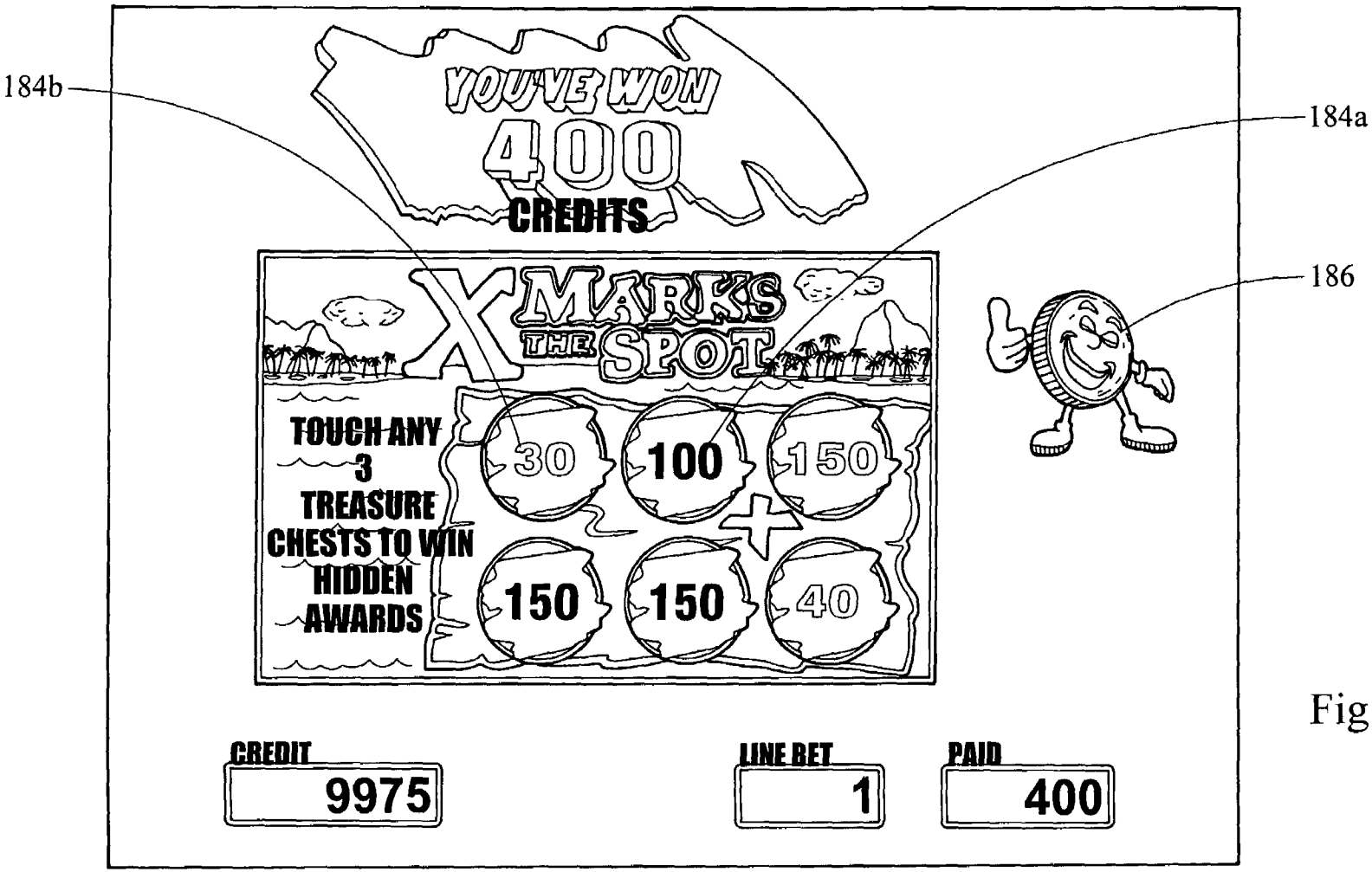
FIG. 15 is an illustration of the second bonus screen of FIG. 14 having all symbols revealed.

Referring to FIG. 15, the player has made the last selection, which reveals another credit award of 150. Optionally, the unselected elements 184*b* are revealed to the player to make the player aware of what the player could have won. Thus, the player has won a total of 400 credits, wherein the most the player could have won was a total of 450 credits.

Figure 16:
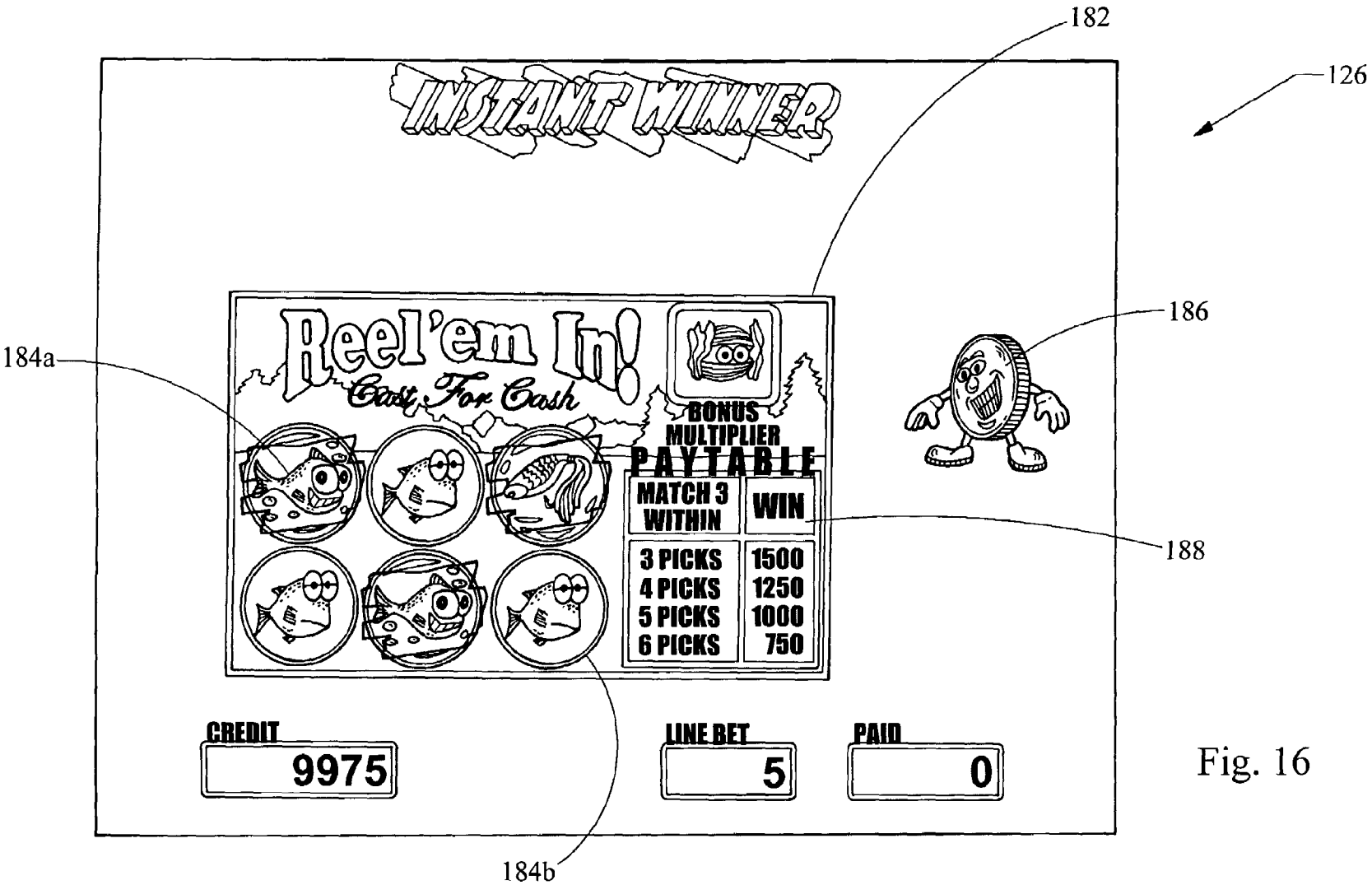
FIG. 16 is an illustration of a second bonus screen of a matching ticket having three symbols revealed, according to the embodiment shown in FIG. 12.

Referring to FIG. 16, the player has selected the REEL 'EM IN! ticket 182 in a subsequent game cycle in which the bonus game has been awarded. The ticket 182 includes six selectable elements 184*a*, 184*b*, and a paytable 188 shows the player the credit award and its corresponding number of selections. To obtain the highest award, the player must match three hidden symbols in the least number of selections, i.e., three selections. For example, the player has made three selections so far. Two selections have revealed a smiling fish, shown in the top left position and in the bottom middle position, and one selection has revealed a fishing lure, shown in the top right position. Thus, so far the player has been unable to match three symbols. The player needs either one more smiling fish symbol or two more fishing lure symbols to have a complete three-symbol match.

Figure 17:
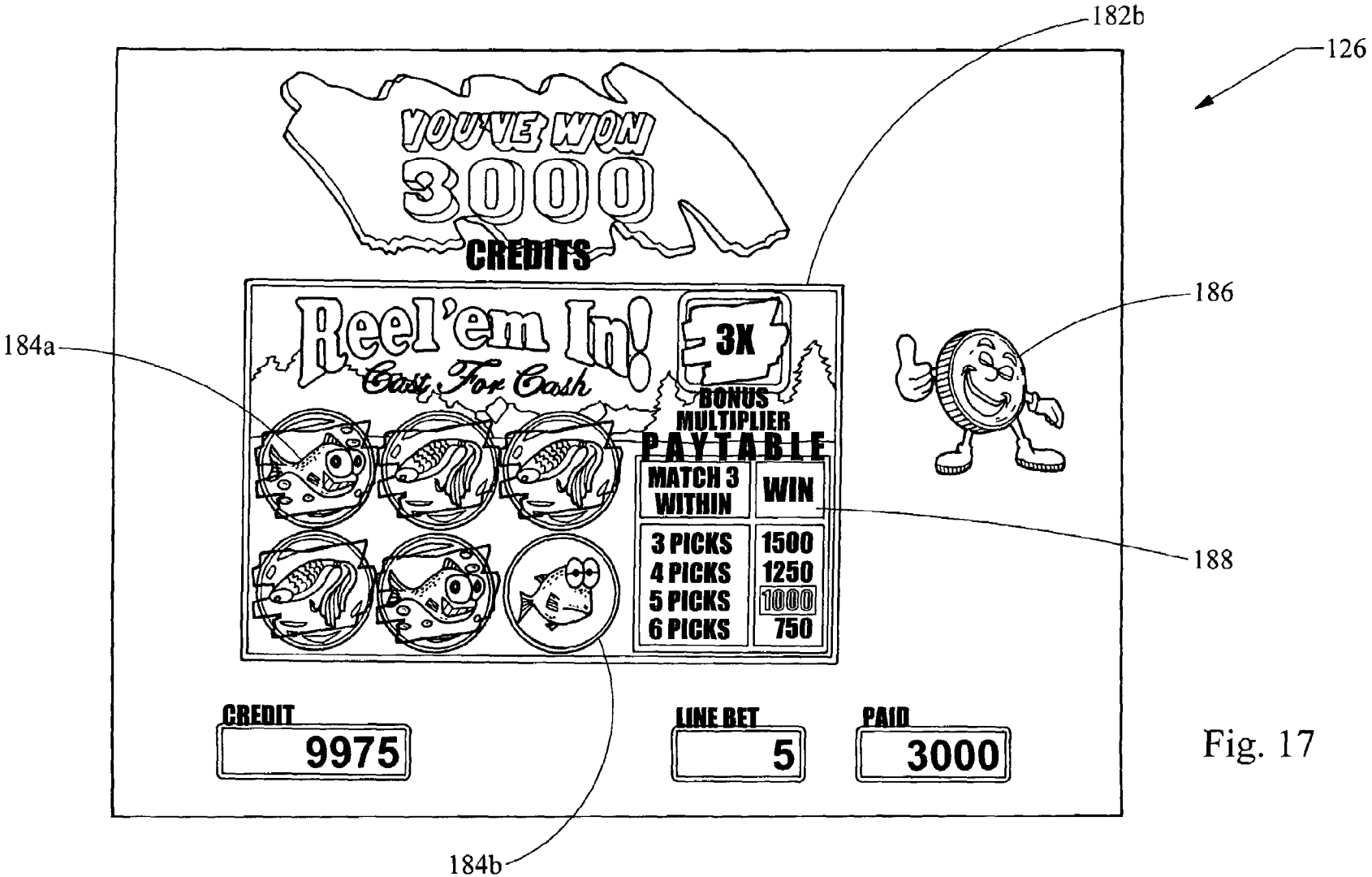
FIG. 17 is an illustration of the second bonus screen of FIG. 16 having all symbols revealed.

Referring to FIG. 17, the player has made two more selections, which reveal two more fishing lure symbols. Thus, the player has been able to match three symbols, the fishing lure symbols, in five selections. Based on the paytable 188, the player is awarded 1,000 credits.

Alternatively, in a subsequent bonus game, triggered in a subsequent game cycle, random changes to the indicia can be made to any indicia described above in reference to the wagering games of FIGS. 12-17. For example, the number of the tickets can be increased or decreased, the layout of the tickets can be altered, the theme of the tickets can be changed, etc.

In accordance with one aspect of the present invention, a method of conducting a wagering game includes receiving a wager input from a player for playing a wagering game. At least one randomly-selected outcome is selected from a plurality of outcomes in response to the receiving step. A video element is presented on a display, wherein the video element obscures from the player a secondary element. In response to detecting a scratch action from the player, a scratch-off of the video element is simulated to reveal the secondary element.

In accordance with another aspect of the present invention, a gaming system for playing a wagering game on a gaming terminal includes a display on the gaming terminal and a controller coupled to the display. The display displays at least one randomly-selected outcome of a plurality of outcomes in response to accepting wager inputs from a player during the wagering game. The controller is programmed to present a video element on the display, wherein the video element obscures from the player a secondary element. The controller is further programmed to simulate, upon detection of a scratch action from the player, a scratch-off of the video element to reveal the secondary element.

While the invention is susceptible to various modifications and alternative forms, specific embodiments thereof have been shown by way of example in the drawings and herein described in detail. For example, although the random change of the visual indicia has been described with respect to bonus games, the random change can also occur in any game of a game cycle, such as a basic game and/or a progressive game. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A method of conducting a wagering game, comprising: receiving a wager input from a player for playing a wagering game on a gaming terminal;

selecting at least one randomly-selected outcome of a plurality of outcomes in response to said receiving step;

presenting a randomly selected first set of visual indicia during a first game cycle of said wagering game, said first game cycle being a previously played game cycle;

presenting a randomly selected second set of visual indicia during a second game cycle of said wagering game, said second game cycle being a previously played game cycle;

based on player game performance, determining whether at least one of said first set and said second set is a preferred set of visual indicia;

including said preferred set of visual indicia in a preferred group of visual indicia, said preferred group including at least two different preferred sets of visual indicia, said preferred group excluding at least one of said first set and said second set; and presenting a third set of visual indicia during a third game cycle of said wagering game, said third set of visual indicia being randomly selected from said preferred group of visual indicia.

2. The method of claim 1, wherein said first set of visual indicia and said second set of visual indicia are selected from an original group of visual indicia, said original group of visual indicia being a broader group than said preferred group of visual indicia.

3. The method of claim 1, wherein each game of said first game cycle, said second game cycle, and said third game cycle is selected from a group consisting of a basic game, a bonus game, and a progressive game.

4. The method of claim 1, wherein said visual indicia includes a plurality of gaming elements, said gaming elements being elements that affect a payout of said wagering game.

5. The method of claim 1, wherein said visual indicia includes a plurality of background elements, said background elements being elements that are not associated with a payout of said wagering game.

6. The method of claim 1, wherein said player game performance includes at least one of previous wagering inputs, time of at least one previous wagering game cycle, and time of at least one previous wagering session.

7. The method of claim 1, wherein said player game performance includes performance of at least one player during at least one gaming session.

8. The method of claim 1, wherein said preferred group of visual indicia includes only said first set of visual indicia and said second set of visual indicia.

9. The method of claim 1, further comprising simulating, in response to detecting a scratch action from the player, a scratch-off of a video element of said visual indicia, said video element obscuring a secondary element of said visual indicia from the player.

10. A method for playing a wagering game, comprising:

receiving wager inputs from a player for playing a wagering game on a gaming terminal;

selecting at least one randomly-selected outcome of a plurality of outcomes in response to said receiving step;

storing a group of visual indicia having a plurality of data sets of visual indicia;

presenting a set of visual indicia from said plurality of data sets during a first game cycle of said wagering game, said first game cycle being a previously played game cycle;

presenting another set of visual indicia from said plurality of data sets during a second game cycle of said wagering game, said second game cycle being a previously played game cycle;

based on previous game performance, excluding at least one of said set and said another set from said group of visual indicia, any remaining sets of said plurality of data sets being deemed preferred sets of visual indicia, said group of visual indicia including at least two different preferred sets of visual indicia; and presenting a preferred set of said preferred sets of visual indicia during a subsequent game cycle of said wagering game by randomly selecting visual indicia from the group of visual indicia after excluding at least one of said set and said another set.

11. The method of claim 10, wherein each game of said first game cycle, said second game cycle, and said subsequent game cycle is selected from a group consisting of a basic game, a bonus game, and a progressive game.

12. The method of claim 10, wherein said visual indicia includes a plurality of gaming elements, said gaming elements being elements that affect a payout of said wagering game.

13. The method of claim 10, wherein said visual indicia includes a plurality of background elements, said background elements being elements that are not associated with a payout of said wagering game.

14. The method of claim 10, wherein said previous game performance includes previous wagering inputs, time of at least one previous wagering game cycle, and time of at least one previous wagering session.

15. A gaming system for playing a wagering game on a gaming terminal, comprising:

a display on said gaming terminal for displaying at least one randomly-selected outcome of a plurality of outcomes in response to accepting wager inputs from a player during said wagering game; and a controller coupled to said display and programmed to present a first set of visual indicia during a first game cycle of said wagering game, said first set of visual indicia being randomly selected from a broad group of visual indicia, said first game cycle being a previously played game cycle;

present a second set of visual indicia during a second game cycle of said wagering game, said second set of visual indicia being randomly selected from said broad group of visual indicia, said second game cycle being a previously played game cycle;

based on previous game performance of one or more players, exclude at least one of said first set and said second set from said broad group of visual indicia to provide a narrow group of visual indicia, any remaining sets of visual indicia in said narrow group of visual indicia being deemed preferred sets of visual indicia, said narrow group of visual indicia including at least two different preferred sets of visual indicia; and present a third set of visual indicia during a third game cycle of said wagering game by randomly selecting visual indicia from said narrow group of visual indicia after excluding at least one of said first set and said second set.

16. The gaming system of claim 15, wherein said previous game performance includes previous wagering inputs, time of at least one previous wagering game cycle, and time of at least one previous wagering session.

17. The gaming system of claim 15, wherein said controller is further programmed to determine said randomly-selected outcome.

18. The gaming system of claim 15, wherein said controller is located within said gaming terminal.

19. The gaming system of claim 15, wherein said controller is further programmed to simulate, upon detection of a scratch action from the player, a scratch-off of a video element of said visual indicia to reveal a secondary element of said visual indicia.

* * * * *